United States Patent [19]

Kägi

[11] Patent Number: 4,711,071

[45] Date of Patent: Dec. 8, 1987

[54] APPARATUS TO STRAP A TAPE AROUND AN OBJECT

[75] Inventor: Bruno Kägi, Uezwil, Switzerland

[73] Assignee: Strapex AG, Switzerland

[21] Appl. No.: 927,642

[22] Filed: Nov. 6, 1986

[30] Foreign Application Priority Data

Nov. 6, 1985 [CH] Switzerland ..... 4769/85

[51] Int. Cl.[4] ..... B65B 13/06

[52] U.S. Cl. ..... 53/589; 100/26

[58] Field of Search ..... 53/589; 100/26, 33 PB

[56] References Cited

U.S. PATENT DOCUMENTS

| | | | |
|---|---|---|---|
| 2,853,938 | 9/1958 | Hall | 100/26 |
| 3,118,368 | 1/1964 | Lems . | |
| 3,497,448 | 6/1969 | Pasic | 100/26 |
| 3,572,237 | 3/1971 | Kurihara | 100/26 |
| 3,613,557 | 10/1971 | Coleman | 100/26 |
| 3,768,396 | 10/1973 | Coleman | 100/26 |
| 3,831,512 | 8/1970 | Johnson | 100/26 |

FOREIGN PATENT DOCUMENTS 3220923 12/1983 Fed. Rep. of Germany .

*Primary Examiner*—John Sipos

*Attorney, Agent, or Firm*—Lowe, Price, LeBlanc, Becker & Shur

[57] ABSTRACT

A tape guidance duct (16) disposed in the manner of an arch bridging the object (20) to be strapped is provided to guide strapping tape (13) when it is being advanced and which releases the tape when it is tensioned around the object (20). The tape guidance duct (16) is assembled in modular manner from a plurality of monolithically formed, sequentially arranged, detachably linked segments (22, 23) which connect with each other by arms extended to fit into corresponding recesses so that, upon such forced engagement, neighboring segments butt together securely at planar end faces and have no lateral play. In this manner the shape and the path of the tape guidance duct (16) is adapted to particular circumstances e.g., different heights or widths of objects being strapped, in simple manner.

10 Claims, 13 Drawing Figures

APPARATUS TO STRAP A TAPE AROUND AN OBJECT

TECHNICAL FIELD

The invention generally concerns an apparatus to strap a tape around an object, and more particularly, to such an apparatus having an easily disassembled tape guidance duct.

BACKGROUND ART

In known tape strapping apparatus, a tape guide duct for guiding tape around an object as a rule is a single machine part so dimensioned that at the user's location, the largest expected object to be strapped will be accommodated by the opening left free by the tape guide duct.

The design entails drawbacks both for the manufacturer of the apparatus and its user. When the manufacturer takes into account the user's wishes, he must make tape guide ducts of diverse sizes and stock these. The user on the other hand will incur some loss of time when strapping if the object being strapped is significantly smaller than the tape guide duct present would allow. Enough length of tape must be advanced in each strapping operation to at least once surround the object, whereupon, when the tape is tightened around the object, it will be retracted again substantially. If the user wishes to avoid this loss of time, he must replace the present and excessively large tape guide duct by a smaller one and possibly he must even order it first from the manufacturer. A significant cost is incurred in shutdown time when changing over from one tape guide duct to another of different dimensions.

DISCLOSURE OF THE INVENTION

One object of the invention is to creat an apparatus of the initially cited kind which shall to a great extent avoid the cited drawbacks.

In accordance with the invention, modular design of the tape guide duct, which herein consists of sequentially arranged, detachably attached segments, is made possible, for instance, by standardizing the segments, to achieve extensive adaptability both to the manufacturer and to the user of the tape guide duct to different sizes of the objects which must be strapped at a much reduced conversion time. As regards the manufacturer furthermore, he need only stock a comparatively small number of segments to practically meet all requirements relative to the format of the tape guide duct.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIGS. 8, 9 and 10 are respectively side, partial top and end views of a segment with a straight guidance means in accordance with a second embodiment;

BEST MODE FOR PRACTICING THE INVENTION

Figure 1:
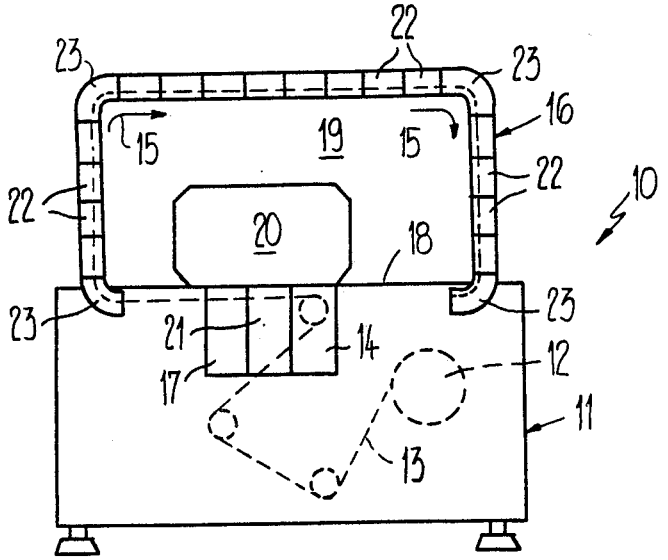
FIG. 1 is a schematic front view of one apparatus in accordance with the invention.

The apparatus 10 shown in FIG. 1 comprises a basic unit 11 housing a supply, for instance a spool 12, of a strapping tape 13 which is drawn off by a takeoff and advance system 14 and which is advanced in the direction of the arrows 15 through a tape guidance duct 16 until the leading end of the tape 13 arrives at a clamping device 17 where it is then held in place. The basic unit 11 is bridged, at its upper surface designed as a work table 18, by the tape guidance duct 16 which assumes the shape of a door arch and which provides an operational opening 19 within which is located an object 20 to be moved onto the work table 18 and be strapped. The moment the leading end of the tape 13 has come to the clamping station 17 and is held in place there, the takeoff and advance unit 14 reverses its motion and thereby tensions the tape 13, which then is released by the tape guidance duct 16, around the object 20. Once the desired tension is reached in the tape 13 around the object 20, a sealing and cutting tool 21 becomes operative and connects together overlapping areas of the tape 13, for instance by fusion, whereafter it severs the tape between the connection site and the takeoff and advance unit 14. This is the overall operation of the strapping apparatus 10 shown and of which the base unit 11 can be of arbitrary design, known per se and available in the trade. For the sake of completeness, reference is also made to Swiss Pat. No. 574,841.

It can be seen in the apparatus 10 shown in FIG. 1 that the tape guidance duct 16 is assembled from a plurality of segments 22, 23, with the segments 22 being straight and the segments 23 illustratively forming an arcuate section of 90° of the tape guidance duct 16. As will be shown further below, the segments 22 and 23 are fastened to each other in an easily detachable manner.

Figure 2:
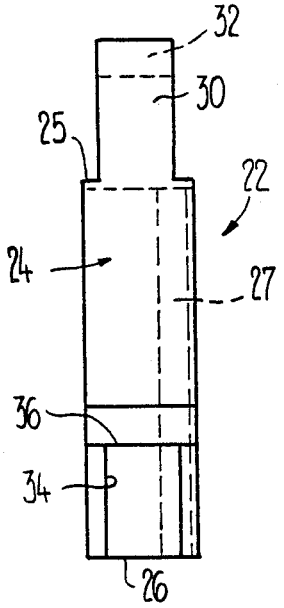
FIGS. 2, 3 and 4 are respectively side, top and end views of a segment with a straight guide means in accordance with a first embodiment which, as a rule, is suited for small hooping widths.
Figure 3:
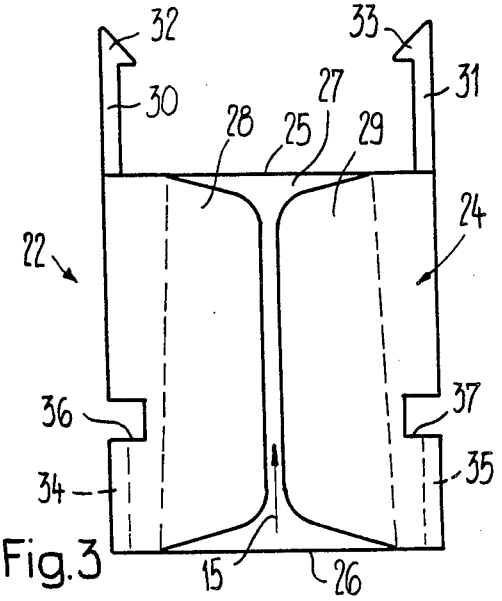
Figure 4:
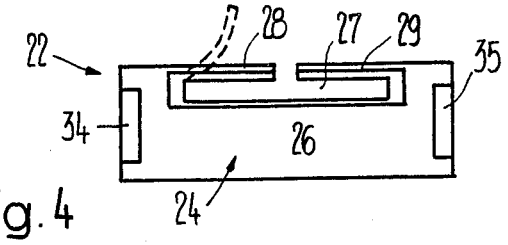

FIGS. 2–4 show a first embodiment mode of a segment 22. Essentially it consists of a parallelipipedic basic body 24 bounded by two plane end or butt surfaces 25, 26 orthogonal to the direction of advance (arrow 15) of the tape when being advanced.

A tape guidance section 27 is present in the basic body 24 and as shown especially clearly by FIG. 4 has a rectangular cross-section while tapering both in height and width as seen in the direction of advance 15 of the tape. On the side facing the work opening 19 (FIG. 1), the tape guidance section 27 in the segment 22 is bounded by two leaves 28, 29 which extend toward each other and which in this example are integral with the basic body 24 made of a plastic, for instance a polyacetal such as "Delrin" or "Hostaform". However, the leaves 28, 29 also may be made of another material and be fastened in suitable manner to the basic body 24. The leaves 28, 29 bend elastically as indicated in dashed lines on the left of FIG. 4 so as to permit the tape to slip out of the tape guidance section 27 when it is being tensioned.

Two connecting arms 30, 31 are integrated into the basic body 24 at the opposite narrow sides of the end face 25 and project at right angles above this end face 25 and have each a snap-in tooth 32 and 33 respectively at their ends. The arms 30, 31 have a rectangular cross-section of which the longer side (FIG. 2) is somewhat less than the thickness of the basic body 24. The arms 30, 31 furthermore can be spread apart somewhat against their intrinsic elasticity.

A groove 34, 35 starting at the end face 26 is present in each of the two narrow sides of the basic body 24 which are perpendicular to the end face 26. The dimensions of the grooves 34, 35 relating to width, depth and length match as accurately as possible the corresponding dimensions of the connecting arms 30, 31. Each of the grooves 34, 35 ends in a notch 36, 37 perpendicular to it receiving one of the snap-in teeth of an adjoining segment 22 or as will be shown further below also of an adjoining segment 23.

Figure 7:
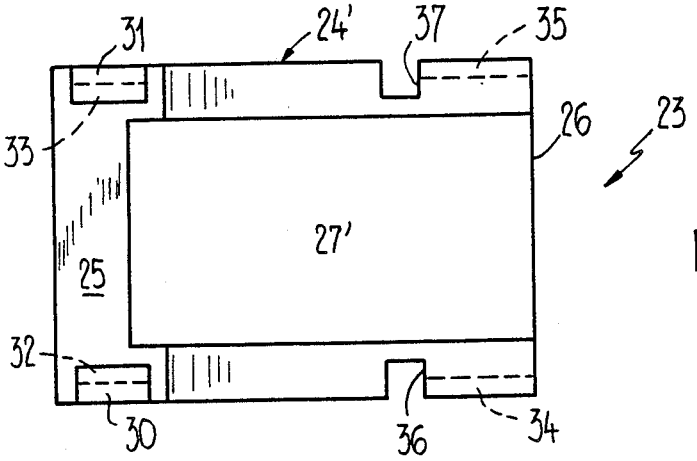
FIGS. 5, 6 and 7 are respectively side, top and end views of a segment with arcuate guide means matching the segment of FIGS. 2–4.
Figure 5:
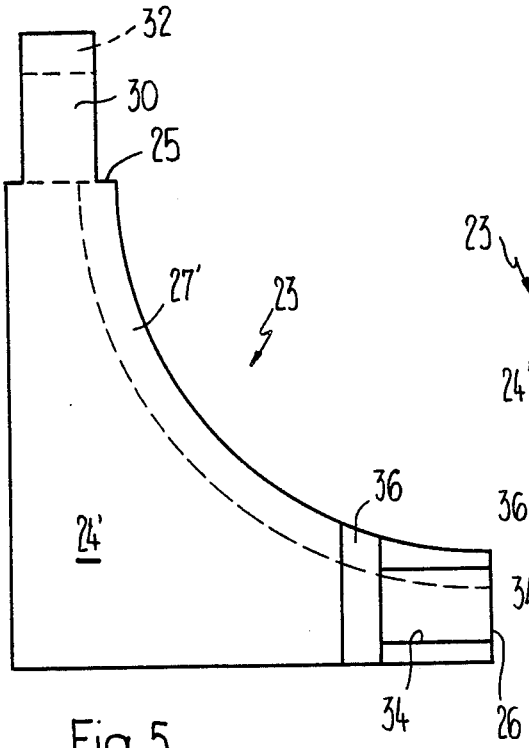
Figure 6:
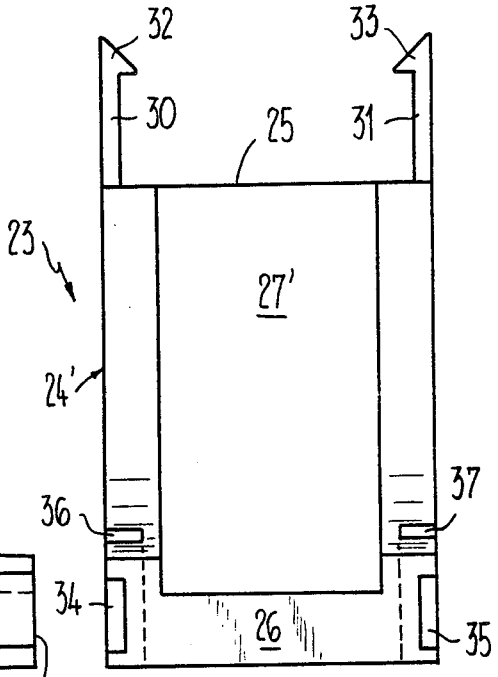

The joining of sequential segments then follows automatically from the above discussion. Illustratively a further segment 22 can be joined from above to the segment 22 shown in FIG. 3 by pressing this further segment 22 by its downward end face 26 on the segment shown. In the process, the arms 30, 31 are spread apart by the shape of the snap-in teeth 32, 33 which slide along the grooves 34, 35 of the further segment until finally then snap into its notches 36, 37. Because the arms 30, 31 precisely fit into the grooves 34, 35, the end face 26 of the further segment sits tightly and as a surface on the end face 25 of the shown segment 22. The tight butting of the two end faces 25, 26 and furthermore also the practically play-free fit of the arms 30, 31 of one of the segments into the grooves 34, 35 of the further segment results in a connection between these two segments 22 which while relatively easily detachable is nevertheless comparatively resistant to bending. FIGS. 5–7 show an embodiment of the segments 23 with an arcuate tape guidance section which fits especially well the segment 22 shown in FIGS. 2–4. Accordingly functionally corresponding parts are assigned the same references as in FIGS. 2–4, and only the essential differences will be discussed below.

The basic body 24' of the segment 23 is not parallelipipedic in its arcuate tape guidance section 27', but it does match in its thickness precisely the width of the basic body 24 of FIGS. 2–4. The basic body 24' also terminates into two plane end or butt faces 25, 26 which however are orthogonal to each other. The tape guidance section 27' assumes the design of this instance of a wide, arcuate, inwardly open groove subtending an angle of 90°. This tape guidance section 27' is not bounded on the inside, that is on its side facing the work opening 19, by leaves, which are not required in this case. The width and the depth of the groove forming tape guidance section 27' approximately correspond to the average width and the average height of the tape guidance sections 27 of the segments 22.

Again arms 30, 31 with snap-in teeth 32, 33 start from the end or butt face 25, and the grooves 34, 35 ending in the notches 36, 37 start from the end or butt face 26. The elements 30–37 of the segment 23 of FIGS. 5–7 are identical in dimension and function to the corresponding elements of FIGS. 2–4.

It must be borne in mind that preferably the effective lengths of the tape guidance sections 27 and 27' are equal to one another. As a result, the manufacturer need only make two kinds of segments to assemble tape guidance ducts of arbitrary sizes and the user is enabled thereby to adapt the tape guidance duct 16 to his extant apparatus 10 and its particulars by a few manual adjustments.

The segments 22 and 23 described in relation to FIGS. 2–7 are directly suitable to make tape guidance ducts 16 of small and medium sizes. As regards large-sized tape guidance ducts, if the above-described segments are used, namely, when a very large number of segments 22 are arrayed one beside the other in the upper arch of the tape guidance duct 16 (FIG. 1), some inward flexure of this span is almost inevitable. While such flexure hardly degrades flawless operation, it may nevertheless be perceived as being objectionable. For this case, the segments shown in FIGS. 8–12 and in FIG. 13 are provided.

Figure 9:
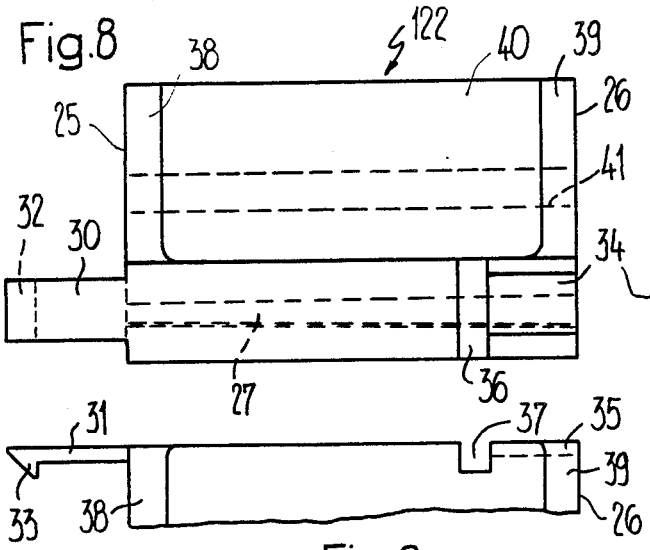
Figure 10:
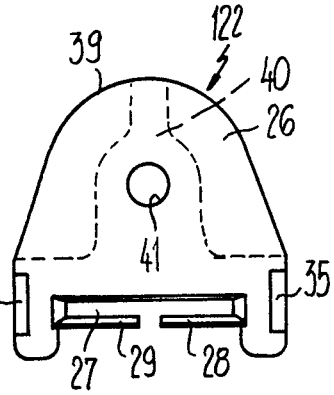
Figure 11:
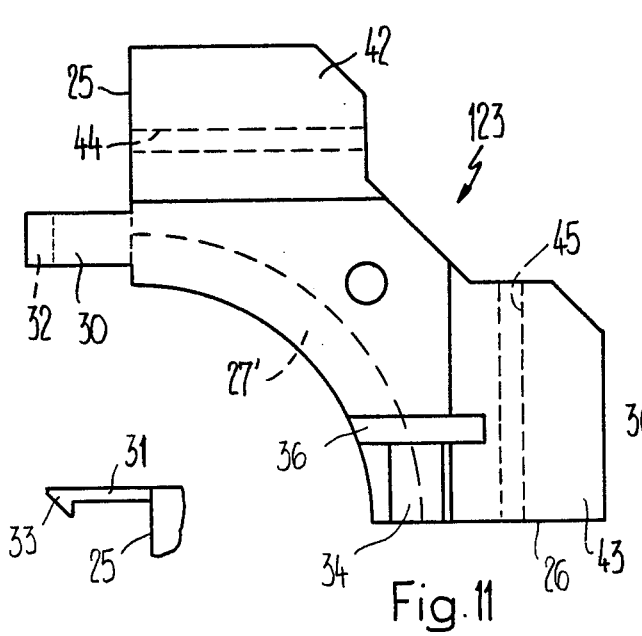
FIGS. 11 and 12 are respectively side and end views of a segment with an arcuate guide means and matching the segments of FIGS. 8–10.
Figure 12:
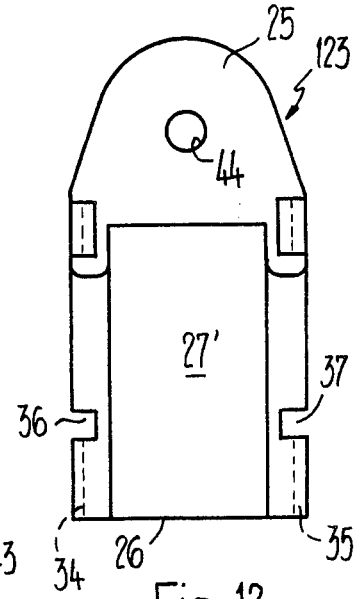
Figure 13:
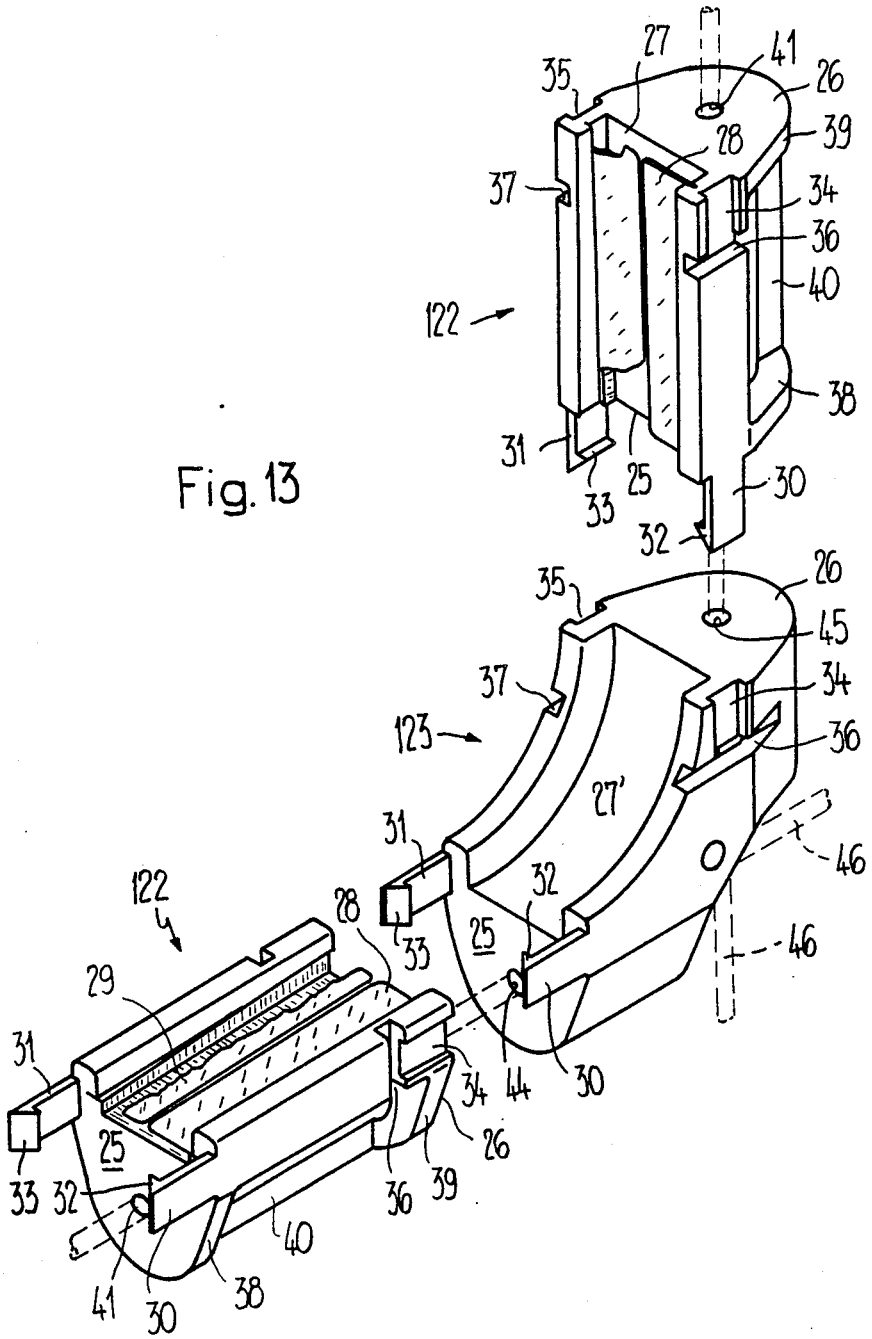
FIG. 13 shows an exploded perspective view of the segments of FIGS. 8–10 and of a segment of FIGS. 11 and 12 to emphasize the simplicity of assembly.

FIGS. 8–10 show a segment 122 for straight guidance and FIGS. 11, 12 a segment 123 for arcuate guidance. The same references are used in FIGS. 8–12 for those elements which functionally correspond to those shown in FIGS. 2–7.

The basic body of the element 122 is supplemented by two integrated end flanges 38, 39 of which the plane and free end surfaces form the end or butt faces 25 and 26 respectively, thereby being of substantially larger sizes than those shown in FIGS. 2–4. The end flanges 38, 39 are joined together by an integrated strengthening rib 40 which is crossed by a continuous bore 41 issuing in the end or butt faces 25, 26. The connecting arms 30, 31 with snap-in teeth 32, 33 project from the end or butt faces 25, grooves 34, 35 terminating into the notches 36, 37 starting at the end or butt face 26. The discussion of FIGS. 2–4 also applies here to the tape guidance section 27 and the leaves 28, 29 bounding it.

Essentially the segment 123 of FIGS. 11, 12 differs from the segment 23 of FIGS. 5–7 in that its basic body is reinforced by two solid, integrated end blocks 42 and 43 of which the free end surfaces substantially increase the size of the end or butt faces 25 and 26 respectively. A bore 44 start orthogonally from the end face 25 and crosses the end block 42, while a similar bore 45 starts from the end face 26 and crosses the end block 43.

Again the arms 30, 31 with the snap-in teeth 32, 33 project from the end or butt face 25 while grooves 34, 35 start from the end or butt face 26 and terminate in the notches 36, 37. The discussion relating to FIGS. 5–7 also applies to the tape guidance section 27'. It should be noted however that the bores 44, 45 are so arranged in the segments 123 that each is flush with the bore 41 in a segment 122 joining the end or butt face 25 and 26 respectively.

FIG. 13 shows how it is possible to connect together the segments 122 and 123 to become a flexure-resistant composite. After the segments 122 and 123 have been plugged together in the desired numbers and arrangement, a stiffer composite is obtained already on account of the bigger sizes of the adjoining end or butt faces 25 and 26. Furthermore, a bracing or clamping means 46 can be pulled through the bores 41 and 44 or 45 and be tensioned in conventional manner whereby a number of segments 122 forming a straight guidance path together with the adjoining segments 124 can be tensioned into a composite offering high resistance to flexure.

Another advantage is obtained if the segments 122 and 123 are made to be compatible with the elements 22 and 23 respectively of FIGS. 2–7 in relation to their elements 30–37 for mutual connection.

It is not mandatory that the segments 23 or 123 forming an arcuate tape guidance section determine a tape deflection of 90°. Larger deflection angles also may be provided whereby the shape of the work opening 19 no longer is square but now is polygonal, which may be a further advantage where objects 20 deviate from the parallel-ipipedic shape. In any event, the described tape guidance duct 16 offers obvious advantages both to the manufacturer and to the user of the apparatus 10, which are absent from conventional apparatus.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

I claim:

1. In an apparatus for strapping objects with a tape, disposed to bridge in the manner of an arch an object to be taped, for guiding the tape around the object as the tape is advanced and releasing the tape when the tape is tensioned and clamped around the object, a tape guidance duct, comprising:

a detachably linked sequence of tape guidance segments, including rectilinear segments and arcuate segments, each of said guidance segments having a monolithic structure of a plastics material formed to provide a low-friction passage for the tape, each of said guidance segments also being formed to have at a first end two integral arms projecting beyond the first end, each of the arms comprising a snap-in tooth, and two recessed clearances extending from a second end toward the first end, such that each two neighboring guidance segments in the linked sequence under external force engage each other securely with the arms of one segment spreading to slide along corresponding recesses of the other until the snap-in teeth fully engage therein and said two neighboring segments butt together with firm contact at end faces formed orthogonal to the direction in which the guided tape advances around the object, wherein the cross-section of said tape passage through each of said rectilinear segments reduces in width and height to form a narrowing tapered passage in the direction of tape advance.

2. Apparatus according to claim 1, wherein:

said arms and said recesses of said segments are formed at two opposed lateral sides at approximately the same level as the tape guidance passage therebetween.

3. Apparatus according to claim 1, wherein:

said arms and said recesses are formed to thereby permit forced engagement without lateral play between connecting segments.

4. Apparatus according to claim 1, wherein:

each of said guidance segments is formed with end flanges having said end faces, said end faces being planar.

5. Apparatus according to claim 4, wherein:

the end flanges of the segments each include a stiffening rib extending in the same direction as the tape guidance section of the segment.

6. Apparatus according to claim 4, further comprising:

means for aligning the end faces of connecting segments to each other.

7. Apparatus according to claim 6, further comprising:

a generally elongate bracing element, and wherein said rectilinear segments providing straight tape guidance are formed to have at least one continuous bore starting from an end flange, passing through the stiffening rib thereof and receiving the bracing element for bracing several of said segments together.

8. Apparatus according to claim 1, wherein:

tape guidance sections of those segments with an arcuate guidance subtend an arc of 90°.

9. Apparatus according to claim 1, wherein:

said rectilinear guidance segments are all of equal length, and wherein tape guidance sections of those segments with arcuate guidance also are all of respective equal lengths.

10. Apparatus according to claim 1, wherein:

said plastics material comprises a polyacetal material.

* * * * *